US007004098B2

(12) United States Patent
Sarantidis

(10) Patent No.: US 7,004,098 B2
(45) Date of Patent: Feb. 28, 2006

(54) CONVERTIBLE ANCHOR

(75) Inventor: Nikolaos Sarantidis, West Palm Beach, FL (US)

(73) Assignee: Anchor Technology, LLC, West Palm Beach, FL (US)

( * ) Notice: Subject to any disclaimer, the term of this patent is extended or adjusted under 35 U.S.C. 154(b) by 0 days.

(21) Appl. No.: 11/032,284

(22) Filed: Jan. 10, 2005

(65) Prior Publication Data

US 2005/0115486 A1 Jun. 2, 2005

Related U.S. Application Data

(63) Continuation of application No. 10/400,939, filed on Mar. 27, 2003, now Pat. No. 6,857,383.

(51) Int. Cl.
*B63B 21/38* (2006.01)

(52) U.S. Cl. ..... 114/304

(58) Field of Classification Search ..... 114/294, 114/297, 298, 301, 302, 303, 304, 306, 310
See application file for complete search history.

(56) References Cited

U.S. PATENT DOCUMENTS

| | | | | |
|---|---|---|---|---|
| 411,948 | A | | 10/1889 | Wixon |
| 1,776,967 | A | | 9/1930 | Eckart |
| 2,424,040 | A | | 7/1947 | Long |
| 2,674,970 | A | | 4/1954 | Andrews |
| 2,940,411 | A | | 6/1960 | Bartels et al. |
| 2,982,244 | A | | 5/1961 | Triechman |
| 3,021,812 | A | | 2/1962 | Swails |
| 3,040,692 | A | | 6/1962 | Hardy, Jr. |
| 3,057,318 | A | * | 10/1962 | Churchward ..... 114/299 |
| 3,059,607 | A | | 10/1962 | Wheeler |
| 3,123,037 | A | | 3/1964 | Jensen |
| 3,138,134 | A | | 6/1964 | Botine |
| 3,397,665 | A | | 8/1968 | Lindly |
| 3,557,739 | A | | 1/1971 | Kaercher |
| 3,759,212 | A | | 9/1973 | Cluett |
| 4,067,287 | A | | 1/1978 | Sabella |
| 4,114,554 | A | | 9/1978 | Miller |
| 4,337,717 | A | | 7/1982 | Gregory |
| 4,417,538 | A | | 11/1983 | El-Ramey |
| 4,469,042 | A | | 9/1984 | Ogg |
| 4,676,184 | A | | 6/1987 | Ogg |
| 5,868,094 | A | | 2/1999 | Al-Sabah |
| 6,035,798 | A | | 3/2000 | Johnson |
| 6,079,761 | A | * | 6/2000 | Sadeck ..... 294/82.1 |
| 6,119,619 | A | | 9/2000 | Fitzmaurice |

FOREIGN PATENT DOCUMENTS

| | | |
|---|---|---|
| FR | 2640224 A1 | 6/1990 |
| GB | 2 066 192 | 12/1990 |

* cited by examiner

*Primary Examiner*—Andrew D. Wright
(74) *Attorney, Agent, or Firm*—Sacco & Associates, PA

(57) ABSTRACT

A convertible anchor capable of being converted between a first position usable on sandy bottom floors and a second position usable on debris laden bottom floors, such as reefs. The convertible anchor may include an elongated shank and one or more flukes rotatably coupled to the elongated shank. The convertible anchor may also include an engagement limiting device placing the convertible anchor in a first position in which the fluke is prevented from rotating relative to the elongated shank. The convertible anchor may also include a catch device so that the convertible anchor can grab a debris laden bottom when the convertible anchor is in the second position.

18 Claims, 5 Drawing Sheets

CONVERTIBLE ANCHOR

CROSS REFERENCE TO RELATED APPLICATIONS

This application is a continuation of application Ser. No. 10/400,939 filed on Mar. 27, 2003, which issued on Feb. 22, 2005 as U.S. Pat. No. 6,857,383, the entirety of which is incorporated herein by reference.

FIELD OF THE INVENTION

This invention is directed generally to anchors, and more particularly to convertible anchors capable of being used on sandy or debris laden bottom floors of bodies of water.

BACKGROUND

There exist many types of anchors such as, but not limited to, mushroom anchors, grapple anchors, and fluke anchors for anchoring floating vessels and other devices in many different water bodies and sea conditions. For instance, a mushroom anchor is shaped as the name implies and is used by boats in areas with little current or wind. A mushroom anchor typically anchors small boats in position using primarily the weight of the anchor. Mushroom anchors typically are not effective in areas having currents, moderate to high wind speeds, or moderate to high seas.

A grapple anchor typically includes one or more hooks coupled to a base end of an elongated shank and is configured to be used to anchor a vessel to a reef. While efficient for anchoring a vessel to a reef, a grapple anchor is ineffective when trying to anchor a vessel to a sandy bottom floor. Many grapple anchors are used effectively by coupling an anchor line to a base end of a grapple anchor, laying an anchor line parallel and adjacent to the elongated shank, and releasably coupling the anchor line to a tip end of the elongated shank using a tie having weak strength. When used, the anchor line pulls on the anchor from the tip end and thus, allows the anchor to be attached to a reef. However, if the grapple anchor becomes snagged, a vessel attached to the anchor line can be moved up-current or up-wind, and the anchor line can be pulled in an opposite direction from a direction in which the anchor line was pulled when the vessel was anchored. Pulling the anchor line in the opposite direction causes the weak tie to break and allows the anchor to be retrieved from the reef by pulling the base end of the anchor in a direction generally opposite to the direction of the points of the hooks on the grapple anchor.

A fluke anchor typically includes two or more flukes rotatably coupled to an elongated shank. The flukes rotatable relative to the elongated shank allow the flukes to penetrate a bottom floor. Fluke anchors work well with bottom floors composed primarily of sand and are most successful when used on bottom floors composed of a combination of sand and clay. However, fluke anchors are not typically effective when used on debris laden bottom floors such as reefs because the flukes often become snagged or entangled in the reef and are not easily released, if at all, by pulling on an anchor line attached to a tip of the elongated shank. Thus, fluke anchors are easily entangled in reefs.

Currently, vessels desiring to anchor in areas having sandy bottom floors and in areas having debris laden bottom floors are generally required to carry two or more anchors on board, which can consume valuable storage space in small vessels. Thus, a need exists for an anchor capable of being attached to a sandy bottom floor and to a debris laden bottom floor.

SUMMARY OF THE INVENTION

This invention relates to a convertible anchor configured to be convertible between an unlatched condition usable on sandy bottom floors and a latched condition usable on debris laden bottom floors, such as reefs. The convertible anchor may be formed from an elongated shaft having a tip end and a base end. One or more flukes may be rotatably coupled to the base end of the elongated shank, and in particular, the one or more flukes may be coupled to a rod that may rotatably coupled to the base end of the elongated shank. The fluke may have one or more edges configured to engage a bottom floor of a body of water. In at least one embodiment, the bottom edge may include on or more points configured to penetrate the bottom floor.

The convertible anchor may include a rotation limiting device for limiting the range of rotation that the fluke may rotate through relative to the elongated shank. In at least one embodiment, the rotation limiting device may formed from one or more plates coupled to the base end of the elongated shank. The plate may be positioned on the base end to allow the fluke to rotate between a position where the fluke is relatively parallel to the elongated shank and a position where the fluke forms an acute angle with the elongated shank. In at least one embodiment, the convertible anchor may include a first plate mounted to one side of the base end of the elongated shank and a second plate mounted to a second side of the base end to allow the fluke to rotate regardless of which side of the fluke contacts the bottom floor.

The convertible anchor may also include at least one engagement limiting device for positioning the convertible anchor in either a latched or an unlatched position. In particular, the at least one engagement limiting device may be used to engage one or more flukes to prevent an edge of the fluke from engaging a bottom floor of a body of water and thereby attaching the convertible anchor to the bottom floor. The engagement limiting device may prevent the fluke from rotating relative to the elongated shank. In at least one embodiment, the engagement limiting device may position the fluke generally parallel to the elongated shank. In particular, the engagement limiting device may position a point of the fluke adjacent to the elongated shank to prevent the point of the fluke from attaching to or penetrating the bottom floor of a water body.

In at least one embodiment, the engagement limiting device may be formed from a fixator that may be slidably mounted to the elongated shank. The fixator may be used to place the convertible anchor in a latched or unlatched position. In the unlatched position, when the fluke is able to rotate within a limited range relative to the elongated shank, the fixator may be held using at least one pin. In one embodiment, the at least one pin may include a hook at one end for securing the fixator in an unlatched position or latched position.

The convertible anchor may include one or more catch devices configured to engage a bottom floor of a body of water. The catch device may be positioned so that the catch device may attach the convertible anchor to a bottom floor when the convertible anchor is in a latched position and the fluke is not in a position to engage the bottom floor. The catch device may also be configured to allow the anchor to be removed from engagement with a debris laden bottom floor by pulling on a line attached to the tip end of the elongated shank. In at least one embodiment, the catch device may be, but is not limited to, a hook coupled to the base end of the elongated shank. These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
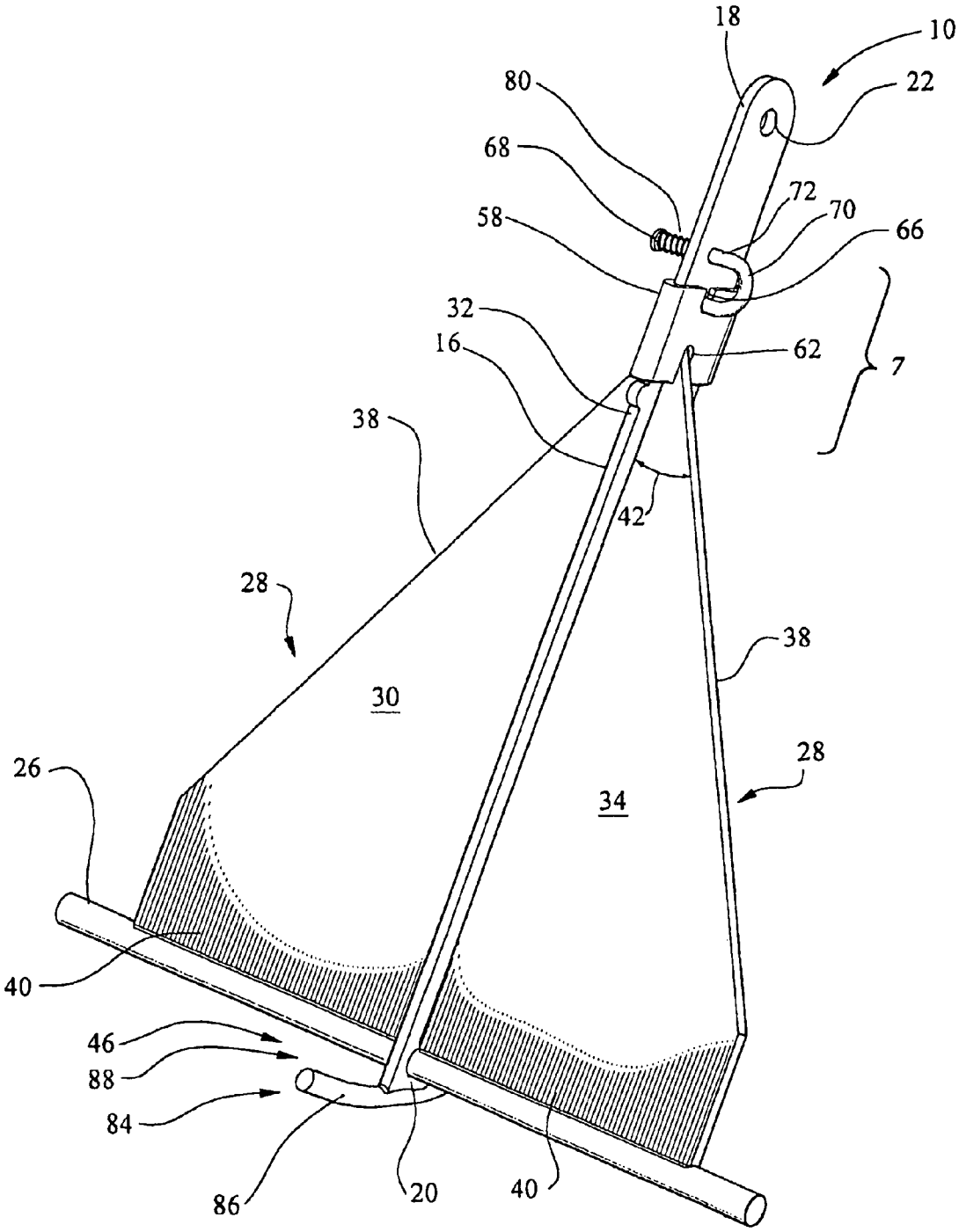
FIG. 1 is a perspective view of a convertible anchor in a latched position.
Figure 2:
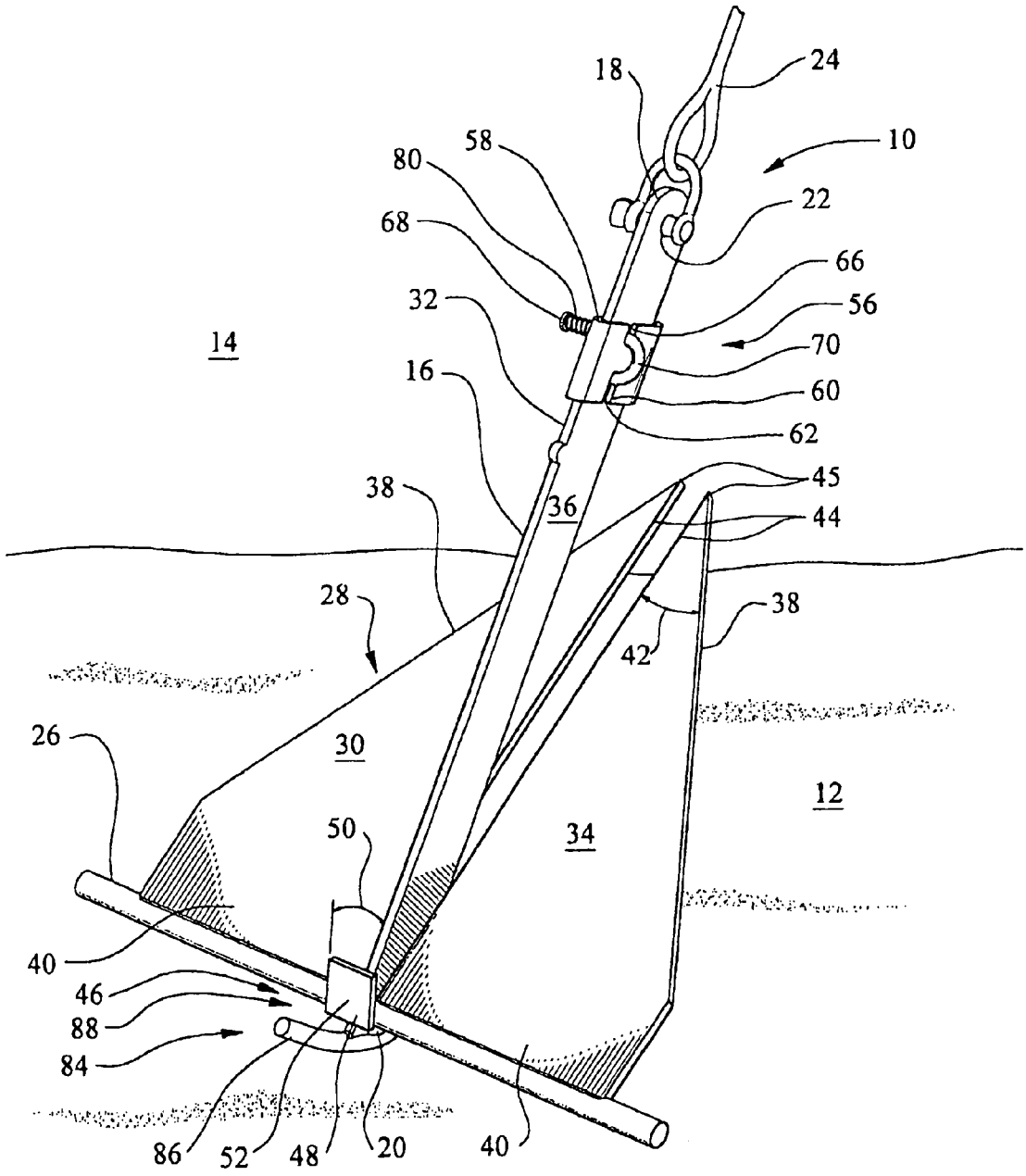
FIG. 2 is a perspective view of the convertible anchor of FIG. 1 in an unlatched position.

This invention is a convertible anchor 10, as shown in FIGS. 1–6, that is capable of being used in at least two positions to attach the convertible anchor to a bottom floor 12 of a body of water 14. A first position of convertible anchor 10, as shown in FIG. 2, enables the convertible anchor to be attached to a sandy bottom floor 12 of body of water 14. A second position of convertible anchor 10, as shown in FIG. 1, enables the convertible anchor to be attached to a bottom floor 12 containing fixed debris, such as, but not limited to, rocks, which may be a naturally occurring reef or an artificial reef, manmade debris, and other items.

As shown in FIGS. 1 and 2, convertible anchor 10 may be formed from an elongated shank 16 having a tip end 18 and a base end 20. Elongated shank 16 may have various shaped cross-sections. Tip end 18 may include one or more orifices 22 to which a line 24 may be attached. Line 24 may be, but is not limited to, a rope, a cable, a chain, any combination thereof, or other device. A rod 26 may be rotatably coupled to base end 20 of elongated shank 16 for supporting one or more flukes 28. One or more flukes 28 may be fixedly coupled to rod 26. In at least one embodiment, a first fluke 30 is coupled to rod 26 on a first side 32 of elongated shank 16, and a second fluke 34 is coupled to a second side 36 of elongated shank 16, which faces generally away from the first side of the elongated shank. While the embodiments shown in the FIGS. 1 and 2 include two flukes 28, convertible anchor 10 is not limited to having two flukes 28. Rather, convertible anchor 10 may have any number of flukes 28 capable of allowing convertible anchor 10 to be attached to bottom floor 12.

Fluke 28 may also include at least one edge 38 configured to engage bottom floor 12. In at least one embodiment, as shown in FIGS. 1 and 2, edge 38 may be formed as a leading edge of fluke 28 positioned generally opposite from end 40 of the fluke. Edge 38 may be at an acute angle 42 relative to an inside edge 44 of fluke 28, thereby forming a point 45 on the fluke. In at least one embodiment, fluke 28 may be substantially planar. However, fluke 28 is not so limited but may have other configurations as well.

Figure 3:
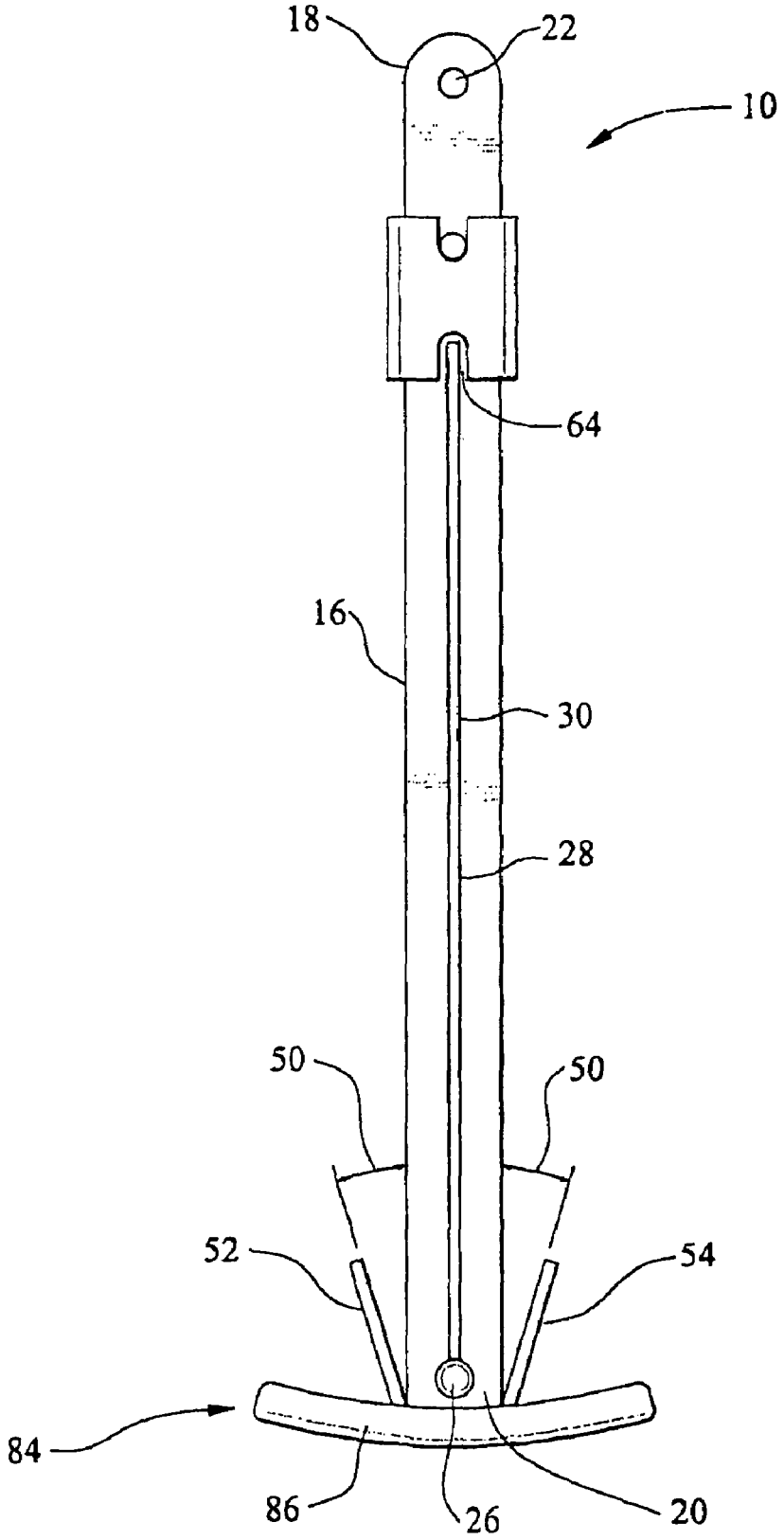
FIG. 3 is a side view of the convertible anchor shown in FIG. 1.

Convertible anchor 10 may also include one or more rotation limiting devices 46, as shown in FIGS. 2 and 3, for limiting rotation of the at least one fluke 28 relative to elongated shank 16. Without rotation limiting device 46, elongated shank 16 could be rotated 360 degrees relative to fluke 28 that pulling on tip end 18 would cause the flukes to become unattached to bottom floor 12. In at least one embodiment, rotation limiting device 46 may include at least one plate 48 coupled to base end 20 of elongated shank 16. The at least one plate 48 may be coupled to base end 20 at an acute angle 50 relative to elongated shank 16. Acute angle 50 may vary between about 5 degrees and about 60 degrees, and more preferably between about 10 degrees and about 25 degrees. However, rotation limiting device 46 is not limited to restricting movement of elongated shank 16 to this range. Rather, in other embodiments, acute angle 50 may vary between other ranges of degrees.

In another embodiment, rotation limiting device 46 may be formed from two plates, whereby a first plate 52, as shown in FIG. 2, is coupled to base end 20 as previously described, and a second plate 54, as shown in FIG. 3, is coupled to base end 20 as described above and is positioned generally opposite to the first plate. In this embodiment, elongated shank 16 may rotate relative to fluke 28 regardless of which side of fluke 28 faces bottom floor 12.

Convertible anchor 10 may include one or more engagement limiting devices 56 for limiting engaging fluke 28 from engaging bottom floor 12 and preventing the fluke from attaching convertible anchor 10 to the bottom floor. In at least one embodiment, engagement limiting device 56 prevents the edge 38 from engaging bottom floor 12, such as by penetrating sandy bottom floor 12, and attaching convertible anchor 10 to bottom floor 12. Engagement limiting device 56 may be any fitting capable of being movable, releasably, or otherwise coupled to elongated shank 16 to maintain fluke 28 aligned with the elongated shank.

Figure 4:
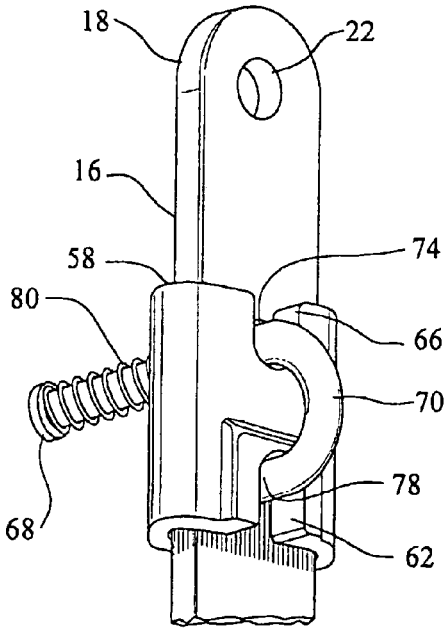
FIG. 4 is partial perspective view of a second side of an elongated shank of the convertible anchor showing a hook attached to a fixator.

In at least one embodiment, engagement limiting device 56 may be formed from a fixator 58, as shown in FIGS. 1–6, slidably coupled to elongated shank 16. Fixator 58 may be configured to receive edge 38 of fluke 28. In particular, fixator 58 may be configured to receive point 45 of fluke 28. Fixator 58 may include one or more slots 60 for receiving point 45 of fluke 28. In at least one embodiment, fixator 58 may include a first slot 62, as shown in FIGS. 1 and 2, for receiving first fluke 30 and a second slot 64, as shown in FIG. 4, for receiving a second fluke 32. Fixator 58 may also include two slots 66 for receiving a pin 68 when fixator 58 is engaged to fluke 28.

Figure 5:
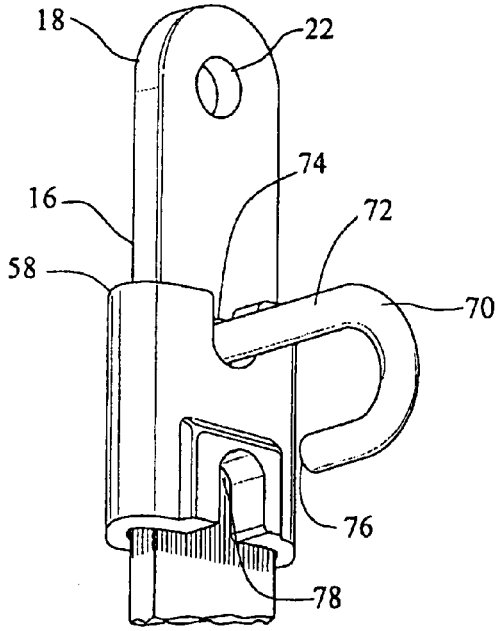
FIG. 5 is a partial perspective view of the second side of the elongated shank of the convertible anchor shown in FIG. 4 with the hook exposed to convert the anchor between a latched condition and an unlatched condition.
Figure 6:
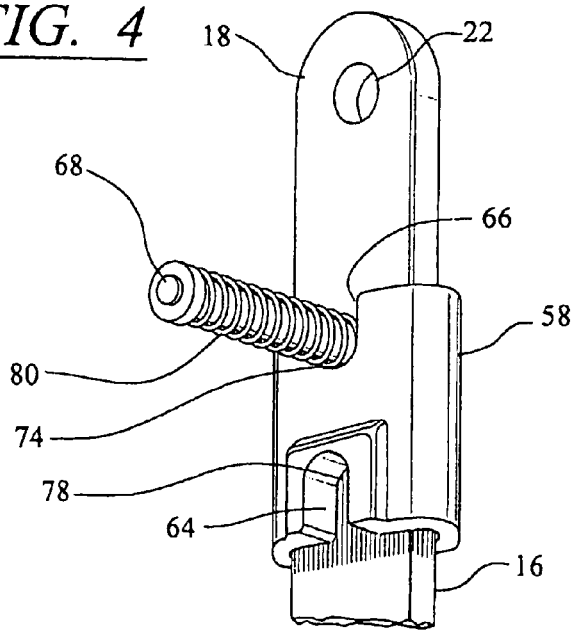
FIG. 6 is a partial perspective view of a first side of the elongated shank of the convertible anchor showing a pin positioned in the elongated shank.
Figure 7:
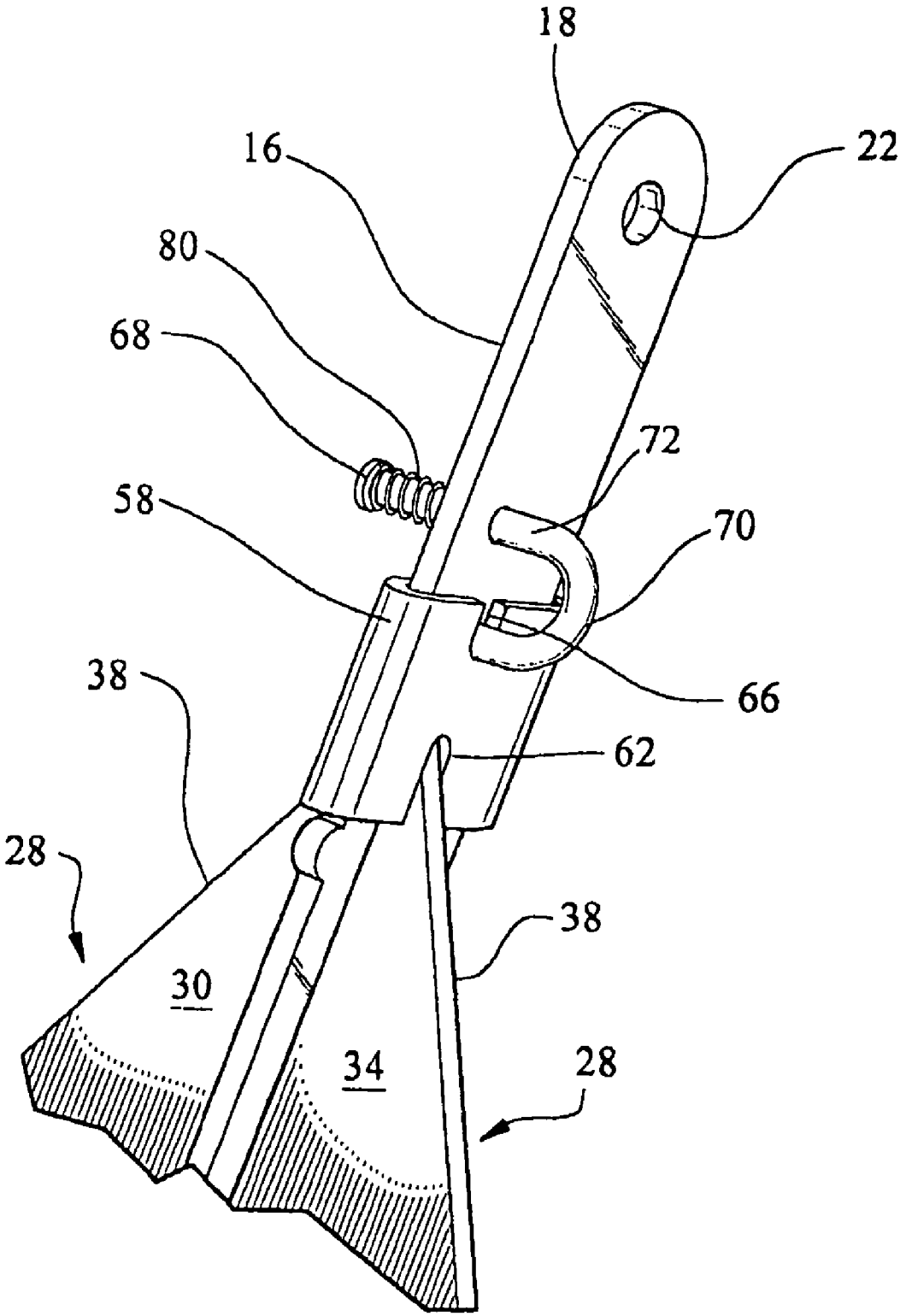
FIG. 7 is a partial perspective view of the second side of the convertible anchor in the latched condition as shown in FIG. 1.

Pin 68 may position fixator 58 in latched and unlatched positions, as shown in FIGS. 1 and 2 respectively. As shown in FIGS. 4–6, pin 68 may include a hook 70 at one end of a shank 72 of the pin. Shank 72 may be positioned in an orifice 74 in elongated shank 16. Shank 72 may be biased toward a position in which a point 76 of hook 70 fits inside an orifice 78 in elongated shank 16. Pin 68 may be biased using one or more springs 80 or other devices. When fixator 58 is in an unlatched position, fluke 28 is free to rotate relative to elongated shank 16 and point 76 of hook 70 may be positioned in slot 60 to prevent fixator 58 from moving. Fixator 58 may be placed in a latched position, as shown in FIG. 1 and in a detailed view in FIG. 7, by sliding the fixator so that fluke 28 engages slot 60 and point 76 of pin 68 is placed into slot 66 of fixator 58 and into orifice 78 of elongated shank 16. In this position, pin 68 bears against fixator 58 in slot 66 while point 45 of fluke 28 engages the fixator in slot 60. In this position, fluke 28 may be prevented from moving relative to elongated shank 16.

Convertible anchor 10 may also include a catch device 84 for engaging bottom floor 12 when the convertible anchor 10 is in a latched position, whereby flukes 28 are prevented from engaging bottom floor 12. Catch device 84 may be formed from any device capable of attaching convertible anchor 10 to bottom floor 12 when the convertible anchor is in a latched position, such as when engagement limiting device 56 is engaged to fluke 28. Catch device 84 is preferably configured to be attachable to a bottom floor 12 having fixed debris, such as, but not limited to rocks, such as naturally occurring reefs and artificial reefs, manmade debris, and other items, and to be easily removed from being in contact with bottom floor 12 by pulling on line 24 attached to tip end 18 of elongated shank 16.

In at least one embodiment, catch device 84 may be at least one hook 86. Hook 86 may be coupled to rod 26. In at least one embodiment, hook 86 may be coupled to a midpoint of rod 26, as shown in FIGS. 1 and 2. Hook 86 may be positioned so that a gape 88 in the hook faces generally toward tip end 18 of the elongated shank 16. Hook 86 may include two gapes 88, whereby each gape 88 is positioned on an opposite side of fluke 28 relative to each other. In another embodiment, hook 86 may be coupled to elongated shank 16 or fluke 28. Hook 86 may be formed from various configurations and sizes. While catch device 84 is described as being formed from a hook, the catch device may be formed from other devices capable of allowing convertible anchor 10 to be removed from a debris laden bottom floor 12 of body of water 14. For instance, in another embodiment, catch device 84 may be a rod that may extend from convertible anchor generally orthogonal to fluke 28. The rod may extend from catch device 84 at other angles as well.

During use, convertible anchor 10 may be used in an unlatched condition, as shown in FIG. 2, whereby fluke 28 freely rotates relative to elongated shank 16 and limited by rotation limiting device 46. Preferably convertible anchor 10 in an unlatched condition is used to anchor a body, such as a boat, or other item to a sandy bottom floor 12. In an unlatched condition, fluke 28 may penetrate the sandy bottom floor 12. Elongated shank 16 may rotate relative to fluke 28, thereby allowing fluke 28 to penetrate sandy bottom floor 12. Convertible anchor 10 may be removed from this position by pulling on line 24 attached to tip end 18.

If bottom floor 12 presents a likelihood that convertible anchor 10 would snag the bottom floor and may it difficult, or impossible, to retrieve the convertible anchor using line 24, the convertible anchor may be used in a latched condition, as shown in FIG. 1. Convertible anchor 10 in the latched condition is ideally suited for use on debris laden bottom floors 12, which may be covered with rock, such as naturally occurring reefs and artificial reefs, manmade debris, and other items. When convertible anchor 10 is in the latched condition, catch device 84 can engage bottom floor 12 and be released from the bottom floor using line 24 coupled to tip end 18.

Convertible anchor 10 may be converted from an unlatched positioned to a latched condition by positioning point 45 in a position to be received by slot 60. If pin 68 is used, pin 68 should be moved so that point 76 of hook 70 is released from slot 60. Fixator 58 may then be slide along elongated body 16 so that point 45 of fluke 28 is received by slot 60. Point 76 of hook 70 may then be inserted into orifice 78 so that hook 70 is positioned in slot 66 and bears against fixator 58. In this position, pin 68 prevents fixator 58 from sliding and releasing fluke 28. Convertible anchor 10 may be returned to an unlatched position by moving pin 68 from orifice 78 and slot 66 so that fixator 58 may be moved to release fluke 28.

Components of convertible anchor 10 identified above may be made of materials such as, but not limited to steel, such as, but not limited to, stainless steel and galvanized steel, aluminum, and other materials having sufficient strength. Convertible anchor 10 may be coated any one or combination of various materials to substantially or completely prevent corrosion of the materials.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. An anchor, comprising:

an elongated shank having a tip end and a base end;

an elongated rod extending transversely from the base end on opposing sides of the elongated shank;

a first fluke and a second fluke, each formed from a broad flat plate, said first and second flukes each respectively attached along one edge to the rod on opposing sides of the elongated shank, each of said flukes tapering to a point opposed from said edge and rotatable about an axis defined by said elongated rod;

at least one engagement limiting device releasably fixing the first and second flukes in a locked position generally parallel to the elongated shank; and at least one catch device exclusive of said flukes attached to said base end in a fixed orientation relative to said elongated shank, said catch device comprising an elongated member extending transversely away from said elongated rod and said elongated shank on opposing sides of said elongated shank to define at least two hooks.

2. The anchor of claim 1, wherein the at least one engagement limiting device comprises a fixator slidably coupled to the elongated shank and having at least one slot for receiving at least one of the first and second flukes.

3. The anchor of claim 2, wherein the at least one engagement limiting device comprises a pin having a hook on one end for engaging the fixator, and wherein the pin extends through an orifice in the elongated shank.

4. The anchor of claim 3, wherein the pin is biased so that a point of the hook is biased toward contacting the elongated shank.

5. The anchor of claim 3, wherein the fixator comprises at least one slot for receiving a shank of the pin.

6. The anchor of claim 1, wherein a gape of each of said hooks faces generally toward the tip end of the elongated shank.

7. The anchor of claim 1, wherein a point of at least one of said first and second flukes is positioned adjacent to the elongated shank when said first and second flukes is in said locked position.

8. The anchor of claim 7, wherein the at least one engagement limiting device is configured to grasp the point of at least one of said first and second flukes.

9. The anchor of claim 1, further comprising at least one rotation limiting device for limiting rotation of the said first and second flukes relative to the elongated shank.

10. The anchor of claim 9, wherein the rotation limiting device comprises first and second plates, each fixed to the base end of the elongated shank on opposing sides of said elongated rod, and secured at an acute angle relative to the elongated shank in a position to limit the angle of rotation of the first and second flukes relative to the elongated shank.

11. An anchor, comprising:

an elongated shank having a tip end and a base end;

an elongated rod extending transversely from the base end on opposing sides of the elongated shank;

a first fluke and a second fluke, each formed from a broad flat plate, said first and second flukes each respectively attached along one edge to the rod on opposing sides of the elongated shank, each of said flukes tapering to a point opposed from said edge and rotatable about an axis defined by said elongated rod;

at least one engagement limiting device movably coupled to the elongated shank for releasably fixing the first and second flukes in a locked position generally parallel to the elongated shank; and at least one catch device exclusive of said rod and said fluke, said catch device comprising at least one elongated rod shaped to define a hook and fixed to said base end of said elongated shank.

12. The anchor of claim 11, wherein the at least one engagement limiting device comprises a fixator coupled to the elongated shank and having at least one slot for receiving at least one of the first and second flukes.

13. The anchor of claim 12, wherein the at least one engagement limiting device comprises a pin having a hook on one end for engaging the fixator, wherein the pin extends through an orifice in the elongated shank.

14. The anchor of claim 13, wherein the pin is biased so that a point of the hook is biased toward contacting the elongated shank.

15. The anchor of claim 13, wherein the fixator comprises at least one slot for receiving a shank of the pin.

16. The anchor of claim 11, wherein a gape of the hook faces generally toward the tip of the elongated shank.

17. The anchor of claim 11, further comprising at least one plate fixed to the base end of the elongated shank and limiting the rotation of at least one of said first and second flukes relative to the elongated shank.

18. A method for utilizing a single anchor for multiple bottom conditions, comprising the steps of:

configuring an anchor for a first operating condition by selectively controlling an engagement limiting device to secure first and second flukes having a broad flat face in a locked position aligned with a plane defined by an elongated shank and an elongated rod mounted transverse to said elongated shank of said anchor to minimize engagement of at least one of a point and an edge of said flukes with a bottom floor of a water body;

engaging rocks on said bottom floor of said water body with said anchor in said first operating condition by using at least one elongated catch device fixed to a base end of said elongated shank and extending away from said elongated shank, said elongated catch device shaped as a hook and oriented transversely to said elongated shank and said elongated rod;

configuring said anchor for a second operating condition by selectively controlling said engagement limiting device to permit said first and second flukes to rotate about an axis defined by said elongated rod a limited angular distance relative to an axis defined by said elongated shank; and engaging sand or mud comprising said bottom floor of said water body with said anchor in said second operating condition using a broad flat face of said first and second flukes.

* * * * *